US008631723B2

(12) United States Patent
Chang

(10) Patent No.: US 8,631,723 B2
(45) Date of Patent: Jan. 21, 2014

(54) RATCHET WRENCH BEING CONVENIENTLY ASSEMBLED

(76) Inventor: Chih-Min Chang, Changhua County (TW)

( * ) Notice: Subject to any disclaimer, the term of this patent is extended or adjusted under 35 U.S.C. 154(b) by 228 days.

(21) Appl. No.: 13/308,914

(22) Filed: Dec. 1, 2011

(65) Prior Publication Data

US 2013/0139655 A1 Jun. 6, 2013

(51) Int. Cl.
*B25B 13/46* (2006.01)

(52) U.S. Cl.
USPC ..... 81/63; 81/63.2

(58) Field of Classification Search
USPC ..... 81/60–63.2
See application file for complete search history.

(56) References Cited

U.S. PATENT DOCUMENTS 4,485,700 A * 12/1984 Colvin ..... 81/62
4,561,329 A * 12/1985 Lack ..... 81/62
6,260,448 B1 * 7/2001 Chaconas ..... 81/63
6,575,060 B1 6/2003 Tseng et al.

* cited by examiner

*Primary Examiner* — David B Thomas
(74) *Attorney, Agent, or Firm* — Browdy and Neimark, PLLC

(57) ABSTRACT

A ratchet wrench includes a handle having a receiving hole, a ratchet wheel rotatably mounted in the handle, a direction controller pivotally mounted in the handle and provided at a periphery thereof with a guide groove, a pawl connected with the direction controller and engaged with the ratchet wheel, and a positioning member. When the direction controller is in a first position, a positioning ball of the positioning member is slidable to the receiving hole of the handle through the guide groove. When the direction controller is turned to a second position, the positioning ball is supported by a spring and engaged with a positioning notch of the direction controller so as to hole the direction controller in position.

4 Claims, 5 Drawing Sheets

RATCHET WRENCH BEING CONVENIENTLY ASSEMBLED

BACKGROUND OF THE INVENTION

1. Field of the Invention

The present invention relates generally to ratchet wrenches, and more particularly, to a ratchet wrench that can be easily conveniently assembled.

2. Description of the Related Art

Conventional reversible ratchet wrenches generally use a direction controller to drive the pawl to move between a left position and a right position. When the pawl is stayed in the left position, the rotatable ratchet wheel that is engaged with the pawl may freely rotate in a counterclockwise direction. On the contrary, the ratchet wheel may freely rotate in a clockwise direction when the pawl is stayed in the right position. In order to hold the direction controller in good position, a positioning member, which includes a coil spring and a positioning ball supported by the coil spring and directly or indirectly stopped at the direction controller, is concealedly installed beneath a bottom of the direction controller. As to the detailed structure of such reversible ratchet wrench, it can be learned from U.S. Pat. No. 6,575,060.

Generally, the positioning ball needs to be simultaneously installed and then engaged in one of the positioning notches of the handle along with the step of installing the direction controller to the handle. However, during the installation process of the direction controller and the positioning ball, the positioning ball tends to drop out of the handle due to the elastic force of the coil spring exerting on the positioning ball. Therefore, the aforesaid installation process is uneasily and inconveniently performed and usually needs to be carried out by a skilled person. In addition, if the positioning ball drops, it will be missing easily.

SUMMARY OF THE INVENTION

The present invention has been accomplished in view of the above-noted circumstances. It is therefore one objective of the present invention to provide a ratchet wrench, the assembly of which can be easily and conveniently performed.

To achieve the above-mentioned objective, the ratchet wrench provided by the present invention comprises a handle, a ratchet wheel, a direction controller, a pawl and a positioning member. The handle is provided at an end portion thereof with a mounting hole, a pivot hole communicated with the mounting hole, and a receiving hole recessed from a wall of the pivot hole. The ratchet wheel is rotatably mounted in the mounting hole of the handle. The direction controller is pivotally mounted in the pivot hole in a way that the direction controller is pivotally moveable relative to the handle between a first position and a second position. The direction controller is provided at a periphery thereof with a guide groove, two neighboring positioning notches, and a stopping protrusion located between the guide groove and one of the positioning notches. The pawl is connected with the direction controller and engaged with the ratchet wheel for being driven by the direction controller to change an engagement orientation between the pawl and the ratchet wheel so as to control a rotation direction of the ratchet wheel. The positioning member includes a spring installed in the receiving hole of the handle, and a positioning ball.

When the direction controller is in the first position, the receiving hole of the handle is communicated with the guide groove, such that the positioning ball, which is put in the guide groove upon assembling, is allowed to slide to the receiving hole of the handle along the guide groove. When the direction controller is turned from the first position to the second position, the receiving hole of the handle is not communicated with the guide groove due to the stopping protrusion and the receiving hole is aimed at the one of the positioning notches, such that the positioning ball is supported by the spring and engaged with the one of the positioning notches. By this way, it is not necessary to worry that the positioning ball will drop during its installation, such that the assembly of the ratchet wrench can be easily conveniently performed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
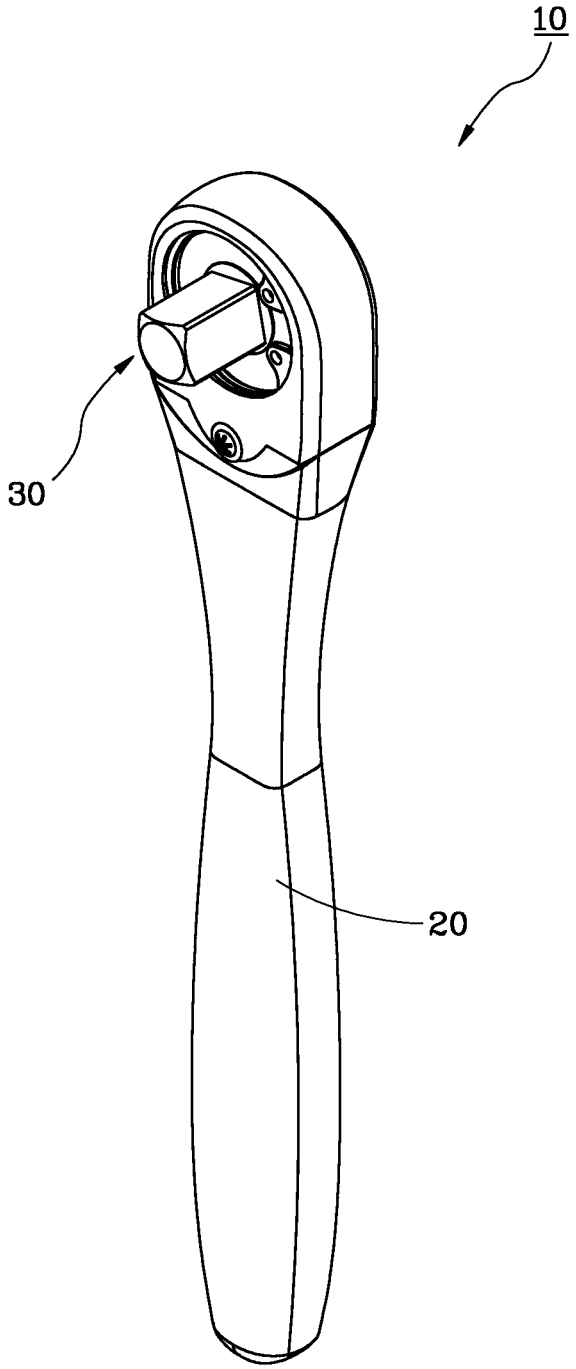
FIG. 1 is a perspective view of a ratchet wrench according to a preferred embodiment of the present invention.
Figure 2:
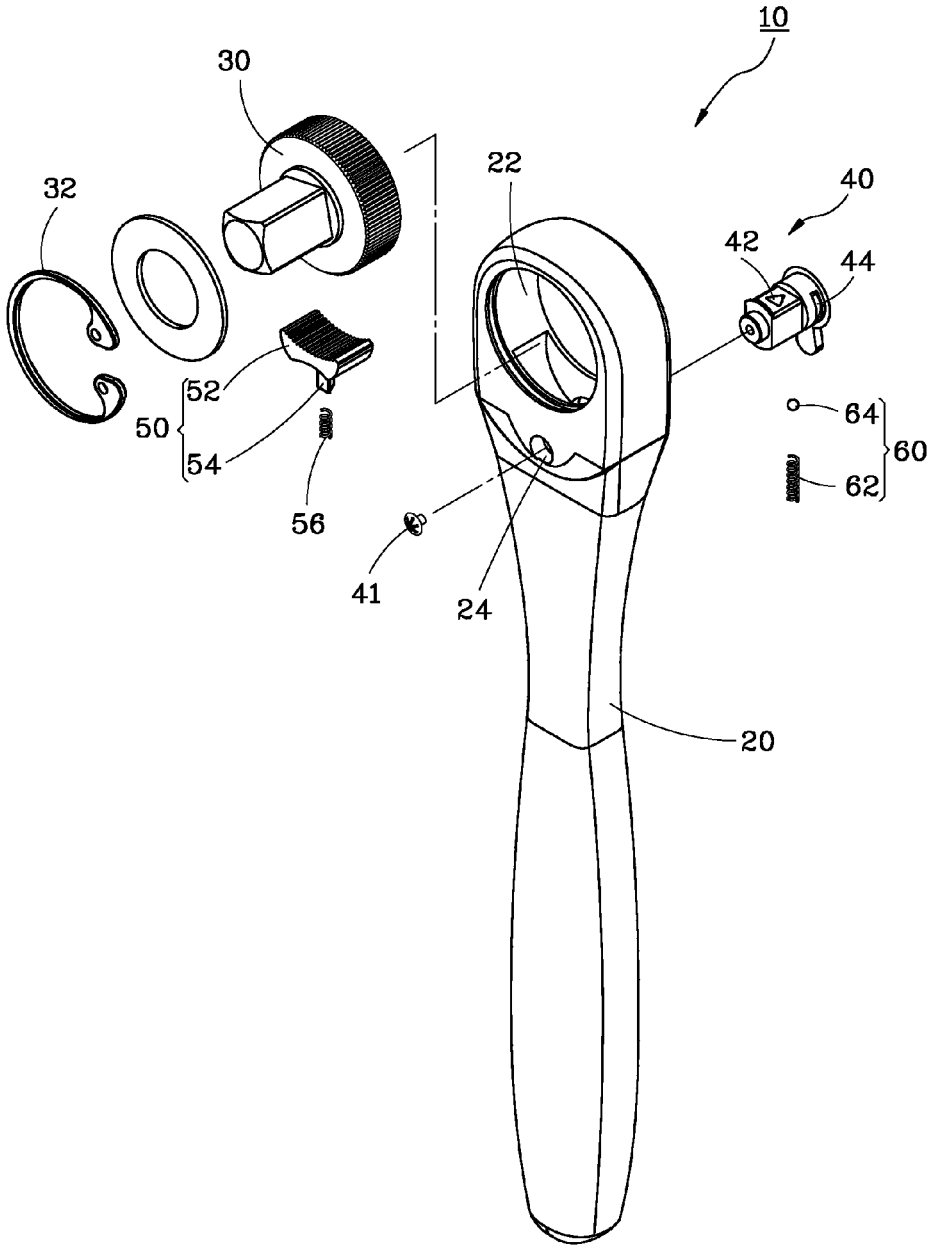
FIG. 2 is an exploded view of the ratchet wrench of the preferred embodiment of the present invention.

As shown in FIGS. 1 and 2, a ratchet wrench, which is provided by a preferred embodiment of the present invention and denoted by the reference numeral 10, comprises a handle 20, a ratchet wheel 30, a direction controller 40, a pawl 50 and a positioning member 60.

Figure 3:
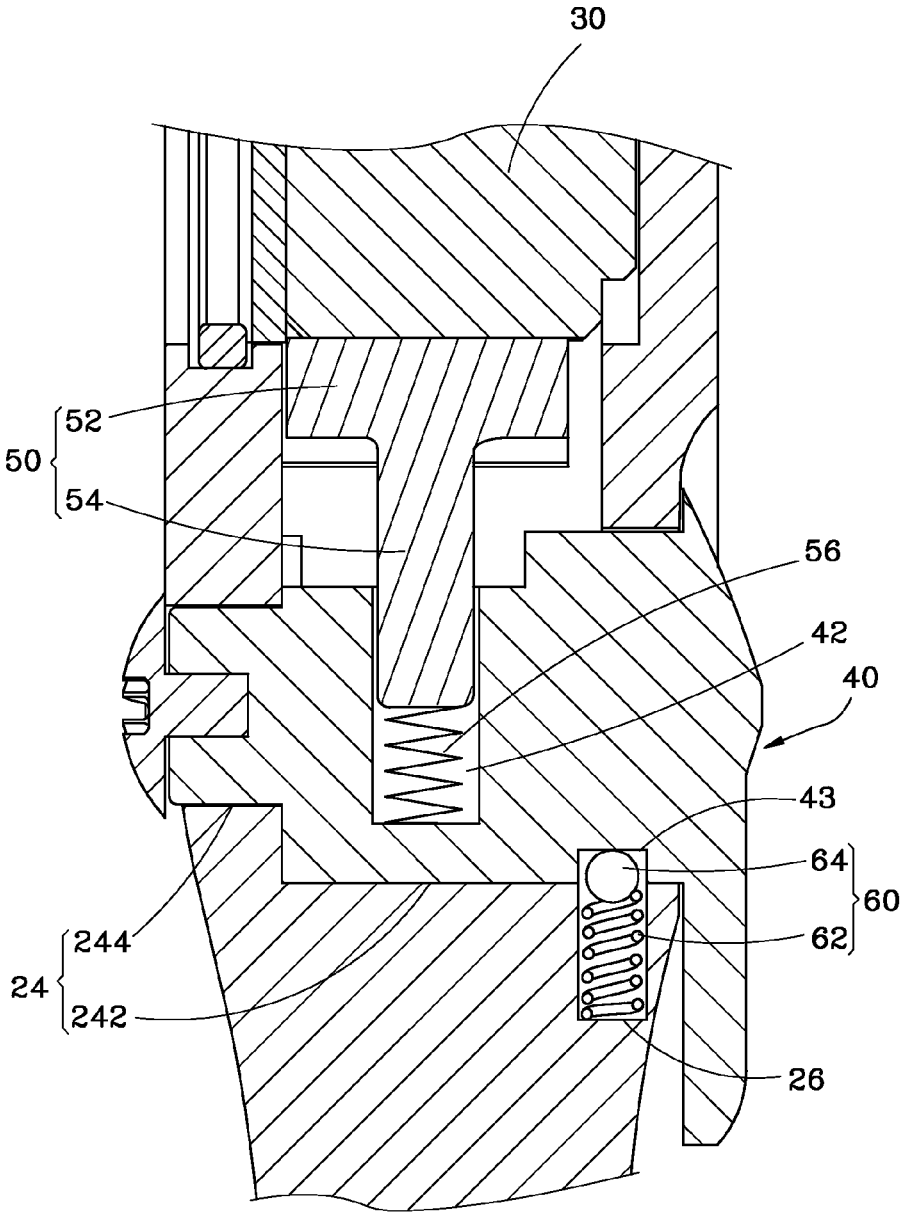
FIG. 3 is a partially cross-sectional view of the ratchet wrench of the preferred embodiment of the present invention.

The handle 20 is provided at an end portion thereof with a ratchet wheel mounting hole 22, a pivot hole 24 communicated with the mounting hole 22 and having a relatively big diameter section 242 and a relatively small diameter 244, and a receiving hole 26 inwardly and radially recessed from a wall of the relatively big diameter section 242 of the pivot hole 24 such that the receiving hole 26 is communicated with the pivot hole 24 as shown in FIG. 3.

The ratchet wheel 30 is rotatably mounted in the mounting hole 22 of the handle 20 by a C-shaped retainer 32.

Figure 4:
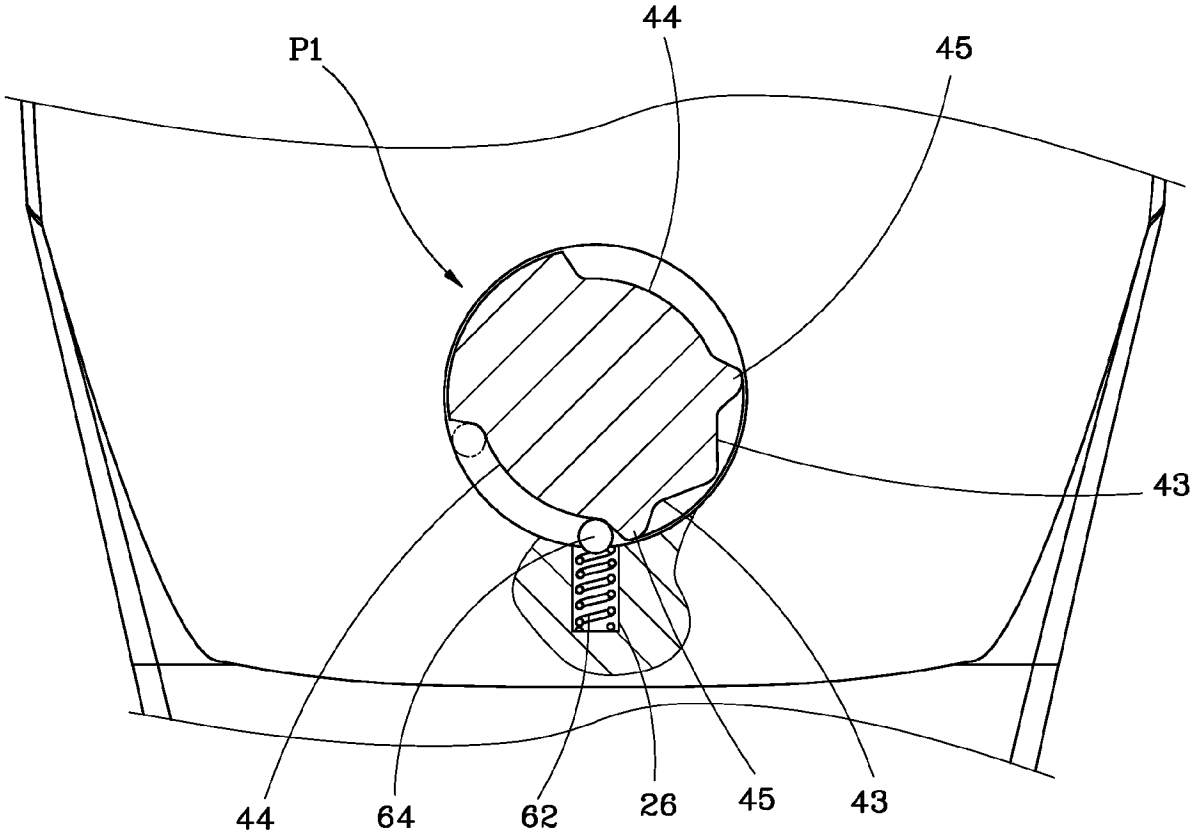
FIG. 4 is another partially cross-sectional view of the ratchet wrench of the present invention, showing that the direction controller is in the first position.

By means of a screw 41, the direction controller 40 is pivotally installed in the pivot hole 24 of the handle 20. As shown in FIG. 4, the direction controller 40 is provided at its top with an insertion hole 42 having a triangular cross section, and at its bottom with two neighboring positioning notches 43, and at its each of two lateral sides with a guide groove 44. In addition, one guide groove 44 and the positioning notch 43 that is close to the aforesaid one guide groove are separated by a stopping protrusion 45. The direction controller 40 is drivenable to pivotally move between a first position where the receiving hole 26 of the handle 20 is communicated with the guide groove 44 as shown in FIG. 4, and a second position where the receiving hole 26 of the handle 20 is not communicated with the guide groove 44 due to the block of the stopping protrusion 45 and the receiving hole 26 of the handle 26 is aimed at the positioning notch 43 as shown in FIG. 5.

The pawl 50 includes a tooth portion 52 engaged with the ratchet wheel 30, and a shaft 54 extending from a bottom of the tooth portion 52. The shaft 54 has a triangular cross section to be loosely fitted with the insertion hole 42 of the direction controller 40. Specifically speaking, the shaft 54 is slidably inserted into the insertion hole 42 with its bottom end stopping against a first spring 56 that is installed inside the insertion hole 42. By means of the rebound force of the first spring 56, the pawl 50 can be properly engaged with the ratchet wheel 30. In addition, the pawl 50 can be driven by the direction controller 40 to change the engagement orientation between the pawl 50 and the ratchet wheel 30 so as to control the rotation direction of the ratchet wheel 30.

Figure 5:
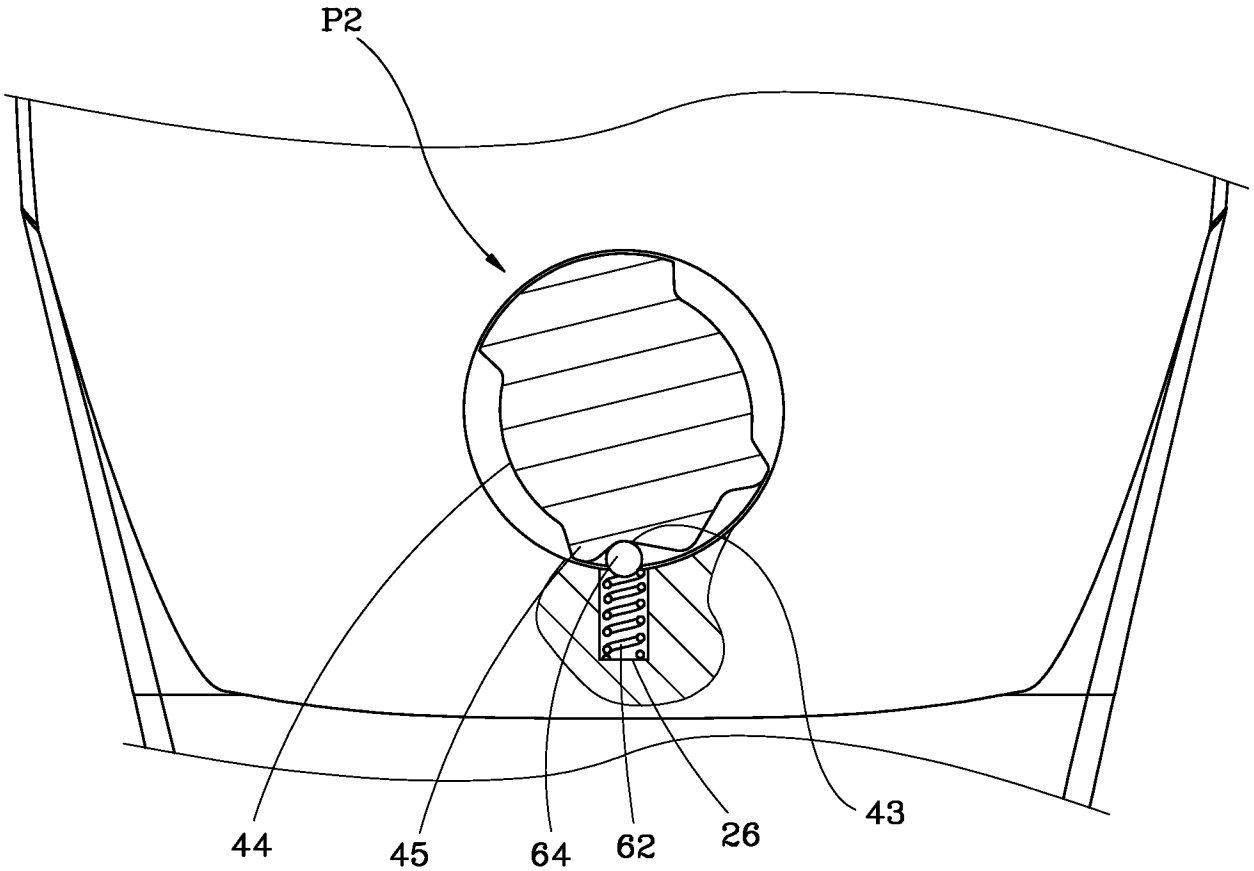
FIG. 5 is similar to FIG. 4, but showing that the direction controller is in the second position.

The positioning member 60 includes a second spring 62 installed inside the receiving hole 26 of the handle 20, and a positioning ball 64 made of steel and set at the top of the second spring 62, such that the positioning ball 64 can be supported by the second spring 62 to be selectively engaged with one of the positioning notches 43 of the direction controller 40, as shown in FIG. 5, so as to hold the direction controller 40 in good position.

The structure of the ratchet wrench 10 of the present invention has been detailedly described as above, and the assembly process of the ratchet wrench 10 will be recited as follows.

In assembly, the second spring 62 is firstly installed in the receiving hole 26 of the handle 20, and thereafter the direction controller 40 is installed in the pivot hole 24 through the opening of the relatively big diameter section of the pivot hole 24, and then the screw 41 is engaged with the direction controller 40 through the opening of the relatively small diameter section of the pivot hole 24, such that the direction controller 40 is pivotally mounted in the handle 20. Thereafter, the positioning ball 64 is put into the guide groove 44 of the direction controller 40 through the mounting hole 22 of the handle 20. Subsequently, the direction controller 40 is turned to the first position to make the guide groove 44 of the direction controller 40 be communicated with the receiving hole 26 of the handle 20, and at the meantime the positioning ball 64 will slide to the receiving hole 26 of the handle 20, as shown in FIG. 4. Thereafter, the direction controller 40 is turned to the second position. During the process of turning the direction controller 40 to the second position, the positioning ball 64 will be pressed by the stopping protrusion 45 of the direction controller 40 and gradually immersed into the receiving hole 26 to compress the second spring 62, and after the stopping protrusion 45 leaves away the positioning ball 64, the positioning ball 64 will be pushed by the rebound force of the second spring 62 to engage one of the positioning notches 43 of the direction controller 40, as shown in FIG. 5, such that the installation of the positioning ball 64 will be completed after the direction controller 40 is shifted to the second position. Thereafter, the shaft 54 of the pawl 50 is inserted into the insertion hole 42 of the direction controller 40 and then the ratchet wheel 30 is installed in the mounting hole 22 of the handle 20 with the retainer 32 so as to complete the whole assembly steps of the ratchet wrench 10 of the present invention.

As described above, because of the design of the guide groove 44, the phenomenon of accidently dropping out the positioning ball 64 during its installation process can be prevented, achieving the purpose of enhancing the convenience in assembly of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A ratchet wrench, comprising:

a handle provided at an end portion thereof with a mounting hole, a pivot hole communicated with the mounting hole, and a receiving hole recessed from a wall of the pivot hole;

a ratchet wheel rotatably mounted in the mounting hole of the handle;

a direction controller provided at a periphery thereof with a guide groove, two neighboring positioning notches, and a stopping protrusion located between the guide groove and one of the positioning notches, the direction controller being pivotally mounted in the pivot hole in a way that the direction controller is turnable relative to the handle between a first position where the receiving hole of the handle is communicated with the guide groove, and a second position where the receiving hole of the handle is not communicated with the guide groove due to the stopping protrusion and the receiving hole of the handle is aimed at the one of the positioning notches;

a pawl connected with the direction controller and engaged with the ratchet wheel for being driven by the direction controller to change an engagement orientation between the pawl and the ratchet wheel so as to control a rotation direction of the ratchet wheel; and a positioning member including a spring installed in the receiving hole of the handle, and a positioning ball, which is slidable to the receiving hole of the handle through the guide groove when the direction controller is in the first position, and is supported by the spring and engaged with the one of the positioning notches when the direction controller is in the second position.

2. The ratchet wrench of claim 1, wherein the direction controller includes an insertion hole, and the pawl includes a tooth portion engaged with the ratchet wheel, and a shaft inserted into the insertion hole of the direction controller.

3. The ratchet wrench of claim 2, wherein the insertion hole of the direction controller and the shaft of the pawl both have a triangular cross section.

4. The ratchet wrench of claim 2, wherein a spring is installed in the insertion hole of the direction controller and stopped at the shaft of the pawl.

* * * * *